US005273021A

United States Patent [19]

Tepper

[11] Patent Number: 5,273,021

[45] Date of Patent: Dec. 28, 1993

[54] BOWSTRING RELEASE DEVICE ADJUSTER FOR ARCHERY

[76] Inventor: Timothy T. Tepper, 1250 Old Ferry Rd., Shady Cove, Oreg. 97539

[21] Appl. No.: 684,822

[22] Filed: Apr. 15, 1991

[51] Int. Cl.[5] ..... F41B 5/00

[52] U.S. Cl. ..... 124/35.2; 124/35.1; 24/135 A; 24/115 H; 403/391

[58] Field of Search ..... 124/35.2, 35.1; 24/129 A, 129 B, 129 W, 130, 129 R, 115 H, 127, 135 A, 135 R, 135 K, 135 N; 403/389, 391, 373, 390

[56] References Cited

U.S. PATENT DOCUMENTS

| | | | |
|---|---|---|---|
| 238,202 | 3/1881 | Arndt . | |
| 372,637 | 11/1887 | Pond | 24/135 R |
| 527,723 | 10/1894 | Sargent et al. | 24/135 R |
| 865,531 | 9/1907 | Robinson | 24/129 A |
| 1,321,660 | 11/1919 | Moriarty | 24/129 A |
| 3,004,532 | 10/1961 | Vance | 124/23.1 |
| 3,352,273 | 11/1967 | Herreshoff et al. | 24/127 |
| 3,800,774 | 4/1974 | Troncose, Jr. | 124/35.2 |
| 3,954,095 | 3/1976 | Lewis | 124/35.2 |
| 4,041,926 | 8/1977 | Troncoso, Jr. | 124/35.2 |
| 4,160,437 | 7/1979 | Fletcher | 124/35.2 |
| 4,476,845 | 10/1984 | Rickard | 124/35.2 |
| 4,662,035 | 5/1987 | Hatfield | 403/389 |
| 4,724,821 | 2/1988 | Besaw | 124/35.2 |
| 4,791,908 | 12/1988 | Pellis | 124/35.2 |
| 4,831,997 | 5/1989 | Greene | 124/35.2 |
| 4,860,720 | 8/1989 | Todd | 24/129 A |
| 4,909,232 | 3/1990 | Carella | 124/35.1 |

*Primary Examiner*—Randolph A. Reese
*Assistant Examiner*—Harry C. Kim
*Attorney, Agent, or Firm*—William H. Maxwell

[57] ABSTRACT

A cord adjuster for a bowstring release device tethered by said cord to a strap extending from an archer's forearm, and having clamp plates and one of which bears upon the strap an has a central opening to adjustably pass opposite ends of the cord which are turned laterally, the opening forming opposite bits over which bites of the cord ends are secured by screws drawing the plates together and pressing the cord ends therebetween.

11 Claims, 1 Drawing Sheet

BOWSTRING RELEASE DEVICE ADJUSTER FOR ARCHERY

BACKGROUND OF THE INVENTION

This invention relates to the release of bowstrings in the practice of archery. Historically, the bow is held forward by the archer's one arm, while the bowstring is drawn back by the archer's other arm preparatory to release of an arrow engaged with the bowstring. In practice, the fletched rear end portion of the arrow is notched to have controlled driving engagement over and from the bowstring when they are released. Since there is a tremendous amount of pressure applied when the bowstring is drawn back for release, difficulty arises in the accuracy of shooting arrows because of undesirable physical movement incurred during the process of release. Accordingly, a number of prior art devices have been proposed and used to improve shooting accuracy, some of which employ a strap that is adjusted to the archer's wrist in order to align the axis of pull with the radius bone of the archer's forearm. It is the adjustment of this wrist strap with which the present invention is concerned.

Wrist straps for the purpose hereinabove described are comprised of a flexible flattened strap that wraps over the anterior of the archer's wrist, and with its opposite end portions overlapped under the archer's palm. The opposite strap ends are reinforced with suitable grommets or the like, through and from which a cord or sections thereof extend on an axis coincidental with said axis of alignment through the archer's forearm and over the wrist to which it is anchored. It is this cord that adjustably secures a bowstring release device to the archer's wrist, it being a general object of this invention to provide adustment means to reliably determine the length of this cord that extends between the strap and the bowstring release device.

The aforesaid adjustment of the anchor strap to the archer's forearm is critical to the accuracy of shooting arrows. Several factors must be coordinated. First the complete draw of the bowstring must be enabled, while second the position of the archer's index finger with respect to the trigger of the bowstring release device must be correct. The purpose of this positioning is to ensure that movement of the triggering finger alone will not disturb or adversely affect the aimed position of the arrow engaged with the bowstring at the point of pull by said device. That is, so that alignement of the arrow axis and the archer's forearm is not disturbed in any way. In order to attain this required adjustment, the anchor cord must be adjusted to an exact length, which heretofore has been quite impossible due to inaccuracy in tying a knot as a stop in said cord. Heretofore, such cords have been tied off in what was thought to be a wanted position, only to discover later that it was too close or most likely too far away from the wanted position. Knots have a tendency to slip, and they inherently tighten under strain, so that the cord lengthens during use and must be continually retied. In actual prior art practice, archers with this type of bowstring release have had persistent problems of the knot slipping, and usually with every shot of an arrow. Consequently, this position displacement takes place at a critical point in time, at the time of shooting and which is of prime concern. To these ends I have provided an improved cord adjuster in combination with a wrist anchor strap and bowstring release device, all as shown and hereinafter described.

The optimum alignment of the arrow and the archer's forearm with the axis of the bowstring release device is described herein, but this does not preclude other axes relationships.

SUMMARY OF THE INVENTION

An adjuster is provided for positioning a bowstring release device, to ensure correct placement of the triggering finger when shooting an arrow. Maladjustment is prevented by securing the anchor cord by means of clamping rather than by tying. Whereas a knot is difficult to tie accurately and will slip and lose adjustment, a properly applied bite is easy to adjust accurately and will not slip or lose adjustment. Accordingly, the adjuster of the present invention is applied in such a manner that adjustment is accurate and is not lost, an adjuster characterized by a pair of plates between which opposite end portions of the anchor cord are disposed radially and so as to emanate from the face of one plate and adjacently parallel one with the other. A feature is the combination of this clamp plate device in stopped engagement with the upwardly faced side of the anchor strap opening or grommet. This plate to strap engagement precludes inaccurate adjustment. A simple screw means draws the plates tightly onto the cord ends that are guided therebetween.

The foregoing and various other objects and features of this invention will be apparent and fully understood from the following detailed description of the typical preferred form and application thereof, throughout which description reference is made to the accompanying drawings.

THE DRAWINGS

Figure 4:
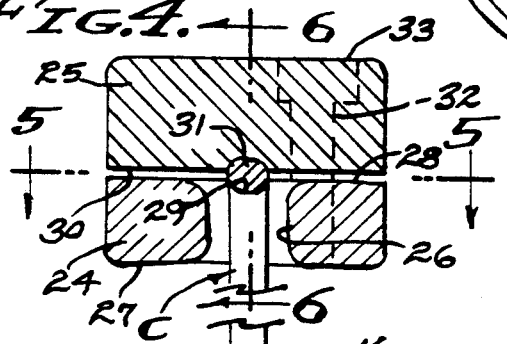
FIG. 4 is an enlarged detailed sectional view taken as indicated by line 4—4 on FIG. 3.
Figure 5:
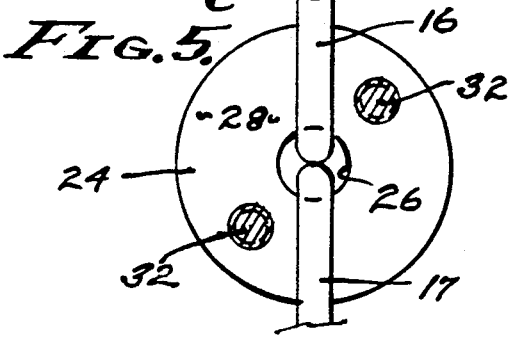
FIG. 5 is an enlarged detailed sectional view taken as indicated by line 5—5 on FIG. 4.
Figure 6:
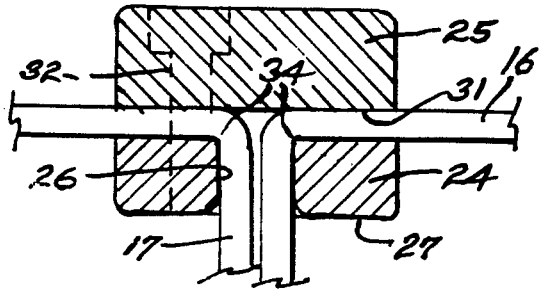

And FIG. 6 is an enlarged detailed sectional view taken as indicated by line 6—6 on FIG. 4.

PREFERRED EMBODIMENT

This invention relates to the combination of a bowstring release device and an adjuster therefor, the purpose being to ensure an adjusted positioning of said device with respect to an archer's hand and triggering finger when the bowstring and arrow shaft are drawn back preparatory to shooting the arrow. It is the reliable restraint of accurate adjustment that is invariably attained, whereby shooting alignment from the arrow through the archer's wrist and forearm is not disturbed. The release device is very sensitive and it is only the archer's triggering finger that is to move, it being imperative that the release device remain positioned so as to make this possible. Accordingly, ordinary tying of the usual anchor cord attachment cannot be tolerated. As shown herein there is a release device R that draws back the bowstring B and arrow shaft S, and there is a wrist strap W shown as it would be wrapped over the anterior of the archer's wrist and tethered to the release device by an anchor cord C. It is the anchor cord C that is securely adjusted by the adjuster A which characterizes this invention. The involved elements are aligned under tension along axis a.

Figure 2:
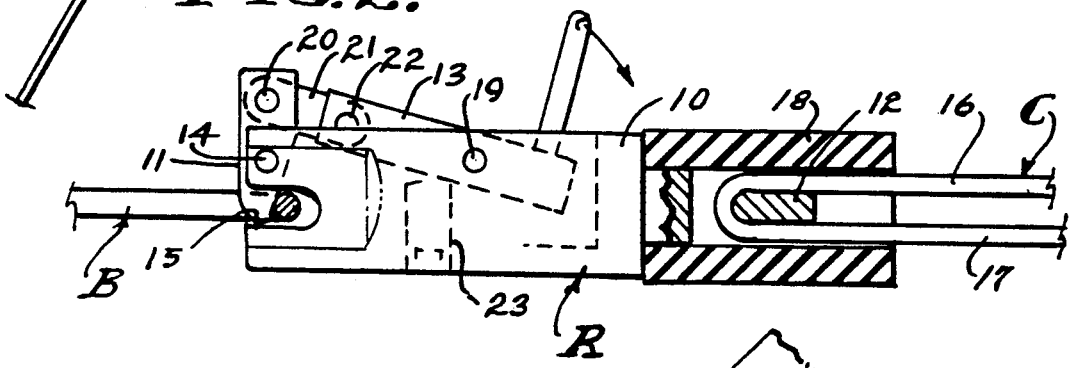
FIG. 2 is an enlarged plan view of the Bowstring Device, taken as indicated by line 2—2 on FIG. 1.

Referring now to FIG. 2 of the drawings, the release device R is a means that releasably engages a bowstring for subsequent release by a sensitive trigger mechanism. A preferred release of this type is shown as comprising an elongated body 10 disposed along the shooting axis a, with a bowstring latch 11 at its forward end, with a cord anchor 12 at is rearward end, and with a trigger lever 13 intermediate said opposite ends of the body. The normal disposition of a bowstring is in a vertical plane, in which case the latch 11 is a horizontally disposed first class lever turning freely on a vertical pivot pin 14 at one side of the body 10 from which its operating arm projects, and with its other end or its other arm in the form of a nose to shift into and out of a vertical notch 15 opening forwardly from the body 10 to receive the bowstring B that releasably passes therethrough. As shown, the arrow shaft S engageably overlies the notched forward portion of body 10 to be drivably engaged by the bowstring.

The cord anchor 12 is a transverse bridge of material extending between opposite side portions of body 10, and over which a loop of cord C is loosely trained so as to extend rearwardly as two substantially parallel sections of cord 16 and 17. A soft rubber or plastic sleeve 18 slides over a reduced diameter of body 10 to protect the anchored turned end of the cord C.

Rearward of the latch 11 and its pivot pin 14, there is a fulcrum pin 19 at said one side of the body 10, spaced from and parallel to the aforesaid pivot in 14. And there is a toggle pin 20 at the outer end of the operating arm of the latch 11 to connect with a toggle link 21 coupled to the trigger lever 13 that rotates laterally from the fulcrum pin 19. The toggle link 21 and trigger lever 13 turn free, joined by a coupling pin 22 intermediate and parallel to pins 14 and 20. When these pins 14, 20 and 22 are aligned and slightly over center, they are in a locked but sensitivity releasable condition. This so called "hair-triggered" condition is set by an adjustment screw 23 that determines a precise over center condition as may be required.

Figure 1:
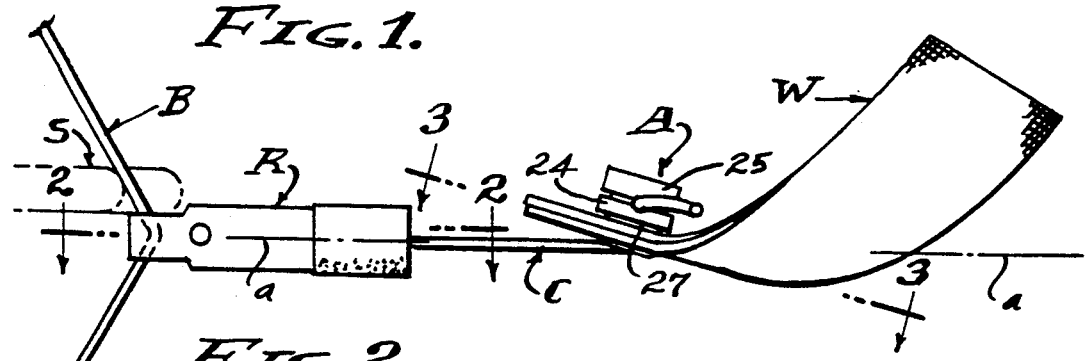
FIG. 1 is a side view of the Bowstring Release Device and Adjuster, positioned as it would be when drawing back a bowstring, as shown.
Figure 3:
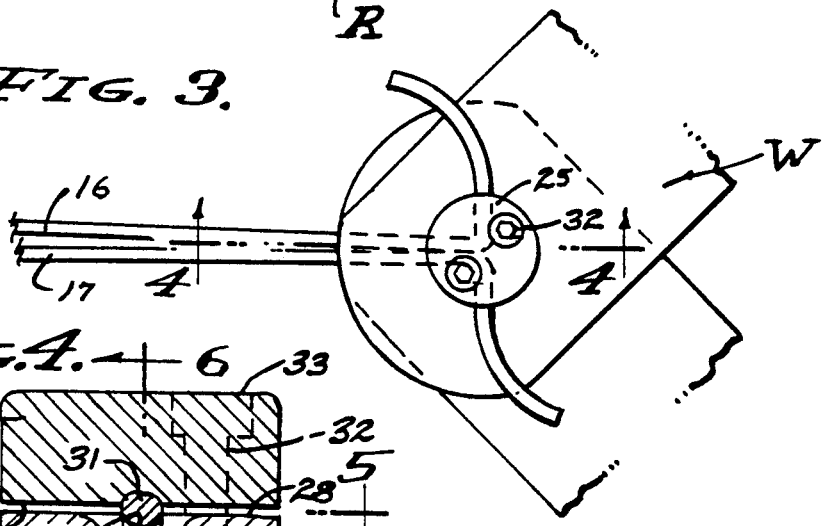
FIG. 3 is an enlarged plan of view of the Adjuster, taken as indicated by line 3—3 on FIG. 1.

It is the foregoing sensitive hair-trigger release device R that is adjustably anchored by the anchor cord C and the adjuster A as will now be described. Accordingly and as clearly shown is FIGS. 1 and 3 of the drawings, the adjuster A is a button—like clamp device that overlies the overlapped end portions of the flat wrist strap W, so as to be accomodated within the cupped posterior or palm of the archer's hand (not shown). As is shown, the adjuster A is comprised of a pair of complementary plates 24 and 25, one overlying the other, and preferably disc-shaped plates.

Plate 24 is a base plate through which there is a central opening 26 for passing the pair of cord sections 16 and 17 extending rearwardly from the turned forwardly anchored end of the cord C. Plate 24 has flat top and bottom faces, the bottom face 27 being engageable flatly against the wrist strap W or a grommet reinforcement or the like through which the extending cord sections project upwardly. The top face 28 has a transverse groove 29 extending diametrically so that diametrically opposite right angular bits 34 are formed where the cord sections 16 and 17 are turned for adjusted securement and so that opposite end portions of sections 16 and 17 emanate from opposite sides of the plate for manipulation as will be required.

Plate 25 is a clamp plate, its bottom face 30 having a transverse groove 31 that is complementary to groove 29 and extending diametrically. The grooves 29 and 31 are shallow with respect to the cross section of cord C to be compressed thereby, whether with one or both grooves 29 and 31. Plates 24 and 25 remain slightly spaced when the cord sections 16 and 17 are securely clamped therebetween. Clamp screw 32 or like means draw the plates 24 and 25 together, such as cap screws accessible at the top face 33 of the plate 25.

From the foregoing it will be understood how the adjuster A is comprised of a pair of easily fabricated parts releasably clamped together by a pair of accessible screws. The single length of cord C is of a high quality substantially non-stretchable highly flexible material adapted to be turned and warped over and around the anchor bridge 12 and over the slightly rounded corner transitions from opening 26 and into the opposite radial portions of the groove 29. Said corner transitions from a right angular bite in the cord sections 16 and 17, the end portions of which are clamped securely between the plates 24 and 25. In practice, the end portions are lightly compressed for sliding engagement and individual radial adjustments, following which the clamp screws 32 are tightened for selectively adjusted securement. The bottom face 27 of plate 24 inherently seeks flat stopped engagement with the flat top of the strap, or with the periphery of the reinforcing grommet. The pair of cord extensions 16 and 17 are inherently tensioned at whatever required angle to be aligned with the shooting axis a coincidental with that of the release device R and its point of releasable engagement with the bowstring B.

Having described only the typical preferred form and application of my invention, I do not wish to be limited or restricted to the specific details herein set forth, but wish to reserve to myself any modifications or variations that may appear to those skilled in the art as set forth within the limits of the following claims.

I claim:

1. In combination with an archery bowstring release device tethered by a cord to a strap extending under tension from an archer's forearm;

there being an opening through and emanating from a flat top of said strap, said cord being turned around an anchor on the release device and having a pair of sections extending rearwardly under tension and turned to project upwardly through said strap opening, a cord adjuster comprised of a base plate and a clamp plate, the base plate having an opening therethrough to pass the pair of cord sections and each turned laterally to overlie a top face of the base plate, and the clamp plate having a bottom face engageable onto the cord sections turned laterally to overlie said top face, and clamp means for drawing the plates together with the cord sections turned laterally to overlie said top face and with the cord sections pressed tightly therebetween, the base plate having a bottom face engaged flatly with and to bear against the flat top of the strap.

2. The archery bowstring release device and tether cord adjuster combination as set forth in claim 1, wherein the opening through the strap is reinforced by a grommet, with the bottom face of the base plate engaged flatly onto said grommet.

3. The archery bowstring release device and tether combination as set forth in claim 1, wherein the base plate has lateral grooves to receive and guide the laterally turned pair of cord sections.

4. The archery bowstring release device and tether cord adjuster combination as set forth in claim 1, wherein the base plate has a pair of grooves extending radially from the opening therethrough to individually receive and guide the laterally turned pair of cord sections.

5. The archery bowstring release device and tether cord adjuster combination as set forth in claim 1, wherein the clamp plate has a transverse groove to receive and guide the laterally turned pair of cord sections.

6. The archery bowstring release device and tether cord adjuster combination as set forth in claim 1, wherein the clamp plate has a transverse groove extending radially and oppositely from the opening through the base plate to individually receive and guide the laterally turned pair of cord sections.

7. The archery bowstring release device and tether cord adjuster combination as set forth in claim 1, wherein the clamp means is a screw means operating between said base plate and clamp plate.

8. The archery bowstring release device and tether cord adjuster combination as set forth in claim 1, wherein the clamp means is a pair of screws operating between said base plate and clamp plate.

9. The archery bowstring release device and tether cord adjuster combination as set forth in claim 1, wherein the opening through the strap is reinforced by a grommet, with the bottom face of the base plate engaged flatly onto said grommet, wherein the base plate has lateral grooves to receive and guide the laterally turned pair of cord sections, and wherein the clamp means is a screw means operating between said base plate and clamp plate.

10. The archery bowstring release device and tether cord adjuster combination as set forth in claim 1, wherein the opening through the strap is reinforced by a grommet, with the bottom face of the base plate engaged flatly onto said grommet, wherein the base plate has a pair of grooves extending radially from the opening therethrough to individually receive and guide the laterally turned pair of cord sections, and wherein the clamp means is a screw means operating between said base plate and clamp plate.

11. The archery bowstring release device and tether cord adjuster combination as set forth in claim 1, wherein the opening through the strap is reinforced by a grommet, with the bottom face of the base plate engaged flatly onto said grommet, wherein the clamp plate has a transverse groove to receive and guide the laterally turned pair of cord sections, and wherein the clamp means is a pair of screws operating between said base plate and clamp plate.

* * * * *